US010420409B1

(12) United States Patent
Crolley

(10) Patent No.: US 10,420,409 B1
(45) Date of Patent: Sep. 24, 2019

(54) NAIL CLIPPER

(71) Applicant: Wayne C. Crolley, Bryant, AR (US)

(72) Inventor: Wayne C. Crolley, Bryant, AR (US)

( * ) Notice: Subject to any disclaimer, the term of this patent is extended or adjusted under 35 U.S.C. 154(b) by 0 days.

(21) Appl. No.: 15/834,309

(22) Filed: Dec. 7, 2017

(51) Int. Cl.
*A45D 29/02* (2006.01)

(52) U.S. Cl.
CPC ..... *A45D 29/02* (2013.01); *A45D 2029/026* (2013.01)

(58) Field of Classification Search
CPC . A45D 29/02; A45D 29/023; A45D 2029/026
USPC ..... 30/27, 28; D28/60
See application file for complete search history.

(56) References Cited

U.S. PATENT DOCUMENTS 2,799,923 A * 7/1957 Senshu ..... A45D 29/023 30/28
2,890,706 A * 6/1959 Guardino ..... A45D 29/02 30/28
2,955,354 A * 10/1960 Laing ..... A01K 17/00 30/29
3,722,518 A * 3/1973 Fravel ..... A45D 29/023 D28/60
3,812,868 A * 5/1974 Keating ..... A45D 29/02 132/75.4
3,832,771 A * 9/1974 Morgan ..... A45D 29/02 30/28
3,943,948 A * 3/1976 Sartore ..... A45D 29/02 30/28
4,062,109 A * 12/1977 Min ..... A45D 29/023 30/28
4,150,481 A * 4/1979 Min ..... A45D 29/023 30/28
4,176,449 A * 12/1979 Lee ..... A45D 29/02 30/28
4,219,929 A * 9/1980 Min ..... A45D 29/023 30/28
4,788,768 A * 12/1988 Ohori ..... A45D 29/02 30/28
4,982,747 A * 1/1991 Shah ..... A45D 29/02 30/28
5,074,041 A * 12/1991 Wagner ..... A45D 29/023 132/75.5
5,323,537 A * 6/1994 Ohori ..... A45D 29/02 30/28
5,459,926 A * 10/1995 Perea ..... A45D 29/023 30/28
5,727,318 A * 3/1998 Reiswig ..... A45D 29/02 30/29
5,832,610 A * 11/1998 Chaplick ..... A45D 29/023 30/28
5,918,375 A * 7/1999 Rossi, III ..... G01B 3/02 132/75.5

(Continued)

FOREIGN PATENT DOCUMENTS

CA 2469360 A1 * 12/2005 ..... A45D 29/02
EP 3231318 A4 * 5/2018 ..... A45D 29/02
FR 2682018 A1 * 4/1993 ..... A45D 29/023

*Primary Examiner* — Jason Daniel Prone
(74) *Attorney, Agent, or Firm* — Joe D. Calhoun

(57) ABSTRACT

A clipper having a digit stop edge preventing the clipping of a fingernail or toenail too close to result in laceration or infection of the tip of the digit having a nail to be clipped. A clipper having a fingertip or toetip guide to stabilize the clipping procedure, and to allow clipping of a fingernail or toenail at a pre-determined length.

4 Claims, 18 Drawing Sheets

(56) References Cited

U.S. PATENT DOCUMENTS

| | | | | |
|---|---|---|---|---|
| 6,557,259 | B1 * | 5/2003 | Nguyen | A45D 29/02 132/75.5 |
| 7,954,242 | B1 * | 6/2011 | Brizan | A45D 29/02 132/75.5 |
| 8,356,414 | B2 * | 1/2013 | Wendorf | A45D 29/02 30/26 |
| 8,496,013 | B2 * | 7/2013 | McCourtney | A45D 29/22 132/73.5 |
| 2004/0148779 | A1 * | 8/2004 | Choi | A45D 29/02 30/28 |
| 2009/0229622 | A1 * | 9/2009 | Malin | A45D 29/02 132/73.5 |
| 2016/0324293 | A1 * | 11/2016 | Wheeler | A45D 29/023 |
| 2016/0330937 | A1 * | 11/2016 | Peschardt | A45D 29/023 |
| 2017/0325567 | A1 * | 11/2017 | Nikaran | A45D 29/02 |

* cited by examiner

NAIL CLIPPER

CROSS REFERENCE TO THE RELATED APPLICATIONS

Not applicable

FEDERALLY SPONSORED RESEARCH AND DEVELOPMENT

Not applicable

MICROFICHE APPENDIX

Not applicable

BACKGROUND OF THE INVENTION (1) Field of the Invention.

The present invention relates to nail clippers. More particularly, the invention disclosed herein relates to nail clippers having guides preventing the clipping of fingernails or toenails too close to the tip of the finger or toe; besides preventing laceration of the tip of such digits, the guide also stabilizes the clipping procedure for the user. Moreover, the disclosed invention enables the user to maintain his or her nails at a desired length. More particularly, the present invention includes nail clippers having adjustable stops for adjusting the distance between the clipping edge and the finger or toe having the nail to be clipped.

(2) Background of the Invention.

Hygienic maintenance of fingernails and toenails can be important to personal health and mobility, but can be difficult for some people. This is especially true for those with impaired vision, dexterity or equilibrium.

Scientific research has determined that, with age, there is a rapid decrease in the growth rate for both toenails and fingernails. As a result, both kinds of nail usually thicken, because of the accumulation of nail cells (called onychocytes). Other factors that can affect the rate of thickening include long-term trauma and impaired circulation. Trauma from falling objects, stubbing injuries, athletic wear and tear, and poorly fitting shoes can alter the cells from which the nails grow; and repetitive incidents or one severe episode can thicken or disfigure the nail plate.

Peripheral arterial disease, which impairs circulation, most often affects the feet and can also cause thickened, brittle nails. As nails become harder and thicker, ingrown toenails may be more common. The tips of the fingernails may also break. Moreover, lengthwise ridges may develop in the fingernails and toenails. With advancing age, normal characteristic changes in the growth rate and morphology of the nail plate occur. Nail plate growth rates of fingernails and toenails normally average 3.0 and 1.0 mm/mo, respectively. With advancing age, starting at the age of 25 years, this rate tends to decrease by approximately 0.5% per year. Various changes in nail plate thickness might occur, typically becoming thicker but in some instances becoming thinner. A decrease in the longitudinal curvature and an increase in the transverse convexity characterize senile changes in the contour of the nail plate. As for texture, there is usually a tendency of the normally smooth nail plate texture to become progressively more friable with increasing age, resulting in fissuring, splitting, and longitudinal superficial or deep striations. Each of these makes hygienic maintenance of nails more difficult.

According to a paper published in Can Fam Physician (the official publication of the College of Family Physicians of Canada, 2011 Feb; 57(2): 173-181), many nail disorders affect the population in general; however, they might appear with increasing frequency with advancing age and include brittle nails, onychauxis, onychocryptosis, infections (especially onychomycosis), onychoclavus, subungual hematoma, splinter hemorrhages, and malignancies of the nail apparatus.[1,2,3,4]

Brittle nail disorder is considered a polymorphic abnormality characterized by increased fragility of the nail plate. It affects around 20% of the population, with increased incidence in women and in older people.[3] It manifests clinically with varying severity of onychoschizia or onychorrhexis. Onychoschizia is usually caused by impairment of intercellular adhesion between the corneocytes that make up the nail plate. This results in transverse splitting of the nail due to breakage of the lateral edges of the nail plate, and in lamellar splitting of the free edge and distal portion of the nail plate. On the other hand, onychorrhexis frequently manifests as nail plate splitting or ridging, longitudinal thickening, or multiple splits leading to triangular fragments at the free edge. Onychocryptosis occurs when the nail plate penetrates into the adjacent lateral nail fold secondary to nail plate overcurvature, subcutaneous in-growing toenail, or lateral nail fold hypertrophy. It manifests clinically with inflammation of the lateral nail fold, which might be associated with granulation tissue and secondary infection. Although more common in young adults, onychocryptosis might infrequently be encountered in older persons, resulting in substantial pain, walking difficulties, and disability.[1,2,4] Underlying causative factors include inappropriate nail cutting.

References

1. Cohen PR, Scher RK. Geriatric nail disorders: diagnosis and treatment. J Am Acad Dermatol. 1992;26(4):521-31. [PubMed]

2. Singh G, Haneef NS, Uday A. Nail changes and disorders among the elderly. Indian J Dermatol Venereol Leprol. 2005;71(6):386-92. [PubMed]

3. Van de Kerkhof PC, Pasch MC, Scher RK, Kerscher M, Gieler U, Haneke E, et al. Brittle nail syndrome: a pathogenesis-based approach with a proposed grading system. J Am Acad Dermatol. 2005;53(4):644-51. [PubMed]

4. Noel B. Surgical treatment of ingrown toenail without matricectomy. Dermatol Surg. 2008;34(1):79-83. Epub 2007 Dec 5. [PubMed]

Already known in the prior art are clippers having a pair of curved plates (one atop the other), joined at one end then curving away and diverging from each other, then terminating with more pronounced curves towards each other to form a jaw-like set of clipping edges/blades on the clipper end; the initial divergence of the plates from the joined ends biases the clipping edges in an open-jaw configuration to accept the nail to be clipped, and the clipping edges are forced together by forcing down an actuation plate pivotally engaged upon a pin extending through aligned holes in the lower and upper plates near the pronounced converging curvature of the jaw-like set of clipping edges.

Currently available nail clippers provide no manner for stabilizing the connection between the clipping edge and the tip of the finger or toe having the nail to be clipped, or for preventing clipping that risks laceration of the tip of that digit, that may cause infection and impair mobility. Currently available nail clippers also the leave the user to "guess" as to the length of the cut of fingernails or toenails; this can lead to nails being cut at different lengths across both hands or feet. In any event, the uncertainty surrounding the clipping of nails, especially toenails by the elderly or users with diminished vision and/or dexterity and/or equilibrium, may result in the neglect of such hygiene altogether.

Accordingly, there is a need for a nail clipper that provides such clipping stabilization, digit-distancing, and selectivity of nail length.

SUMMARY OF THE INVENTION

The primary feature of the present invention is a stop edge which prevents the user from clipping the nail too close to the tip of the finger or toe having the nail to be clipped, to prevent laceration of the tip of that digit. Contact between the stop edge and the tip of the finger or toe having the nail to be clipped also adds stability to the clipping procedure. That stop edge also allows the user to cut the nail at a precise, preset length. This feature solves both aesthetic and health concerns. For example, it is difficult for many users to avoid clipping his or her nails too closely, sometimes causing infection, discomfort and/or impaired mobility. This is especially true of users that may have diminished dexterity, vision or balance; examples may include elderly users, especially elderly users attempting to clip toenails.

One primary benefit of the disclosed invention is that it provides stability to the clipping procedure.

Another benefit of the disclosed invention is that it prevents clipping of fingernails or toenails so close that laceration or infection may result.

Another benefit of the disclosed invention is that it provides a means for pre-determining the length of the nail to be clipped, allowing for any desired uniformity or controlled variability of nail length.

BRIEF DESCRIPTION OF THE DRAWINGS

The novel features believed characteristic of the disclosed subject matter will be set forth in the claims of this application. The disclosed subject matter itself, however, as well as a preferred mode of use, further objectives, and advantages thereof, will best be understood by reference to the following detailed description of illustrative embodiments when read in conjunction with the accompanying drawings.

DETAILED DESCRIPTION OF THE INVENTION

Figure 1:
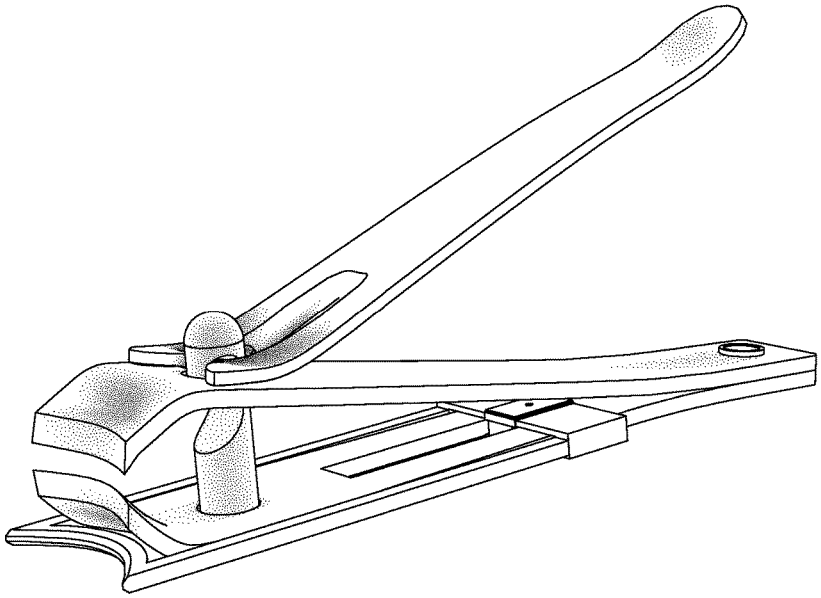
FIG. 1 is a perspective view of a representative sample of a nail clipper of the present invention, having an adjustable nail measurement guide.
Figure 2:
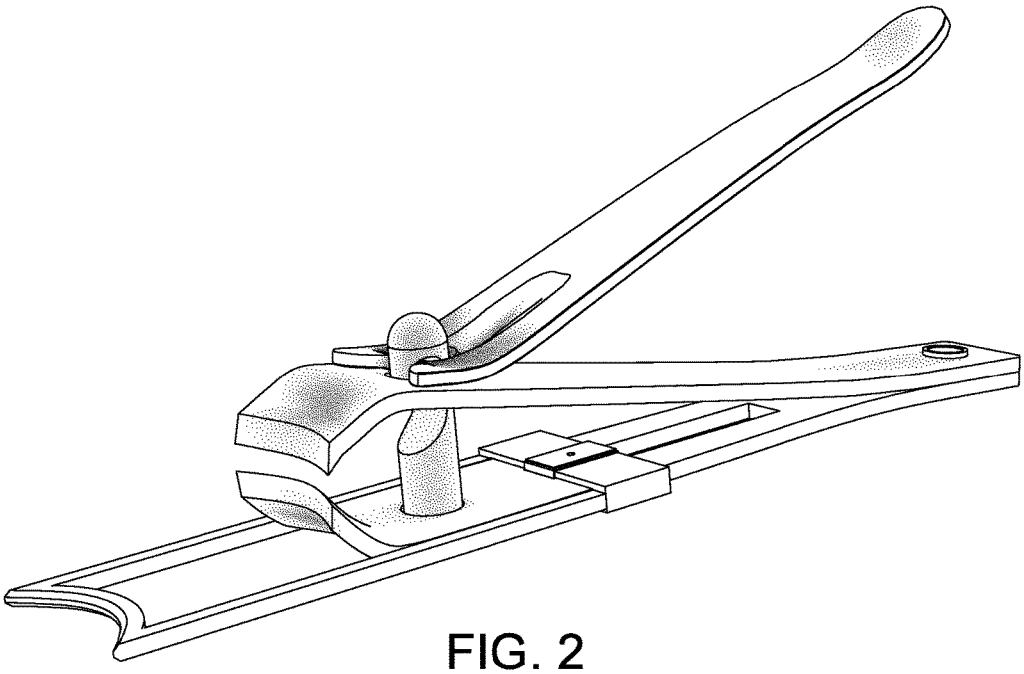
FIG. 2 is a perspective view of the nail clipper of FIG. 1, in a further extended configuration.

The terminology used herein is for the purpose of describing particular embodiments only, and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

For the sake of simplicity and to give the claims of this patent application the broadest interpretation and construction possible, the conjunctive "and" may also be taken to include the disjunctive "or," and vice versa, whenever necessary to give the claims of this patent application the broadest interpretation and construction possible. Likewise, when the plural form is used, it may be taken to include the singular form, and vice versa.

It will be understood that, although the terms first, second, third, etc. may be used herein to describe various elements, these elements should not be limited by these terms. These terms are only used to distinguish one element from another element.

The disclosure herein is not limited by construction material(s) to the extent that such materials satisfy the structural and/or functional requirements. For example, any material may be used so long as it satisfies the rigid structural and functional requirements for which it is being used.

In general, the present invention comprises (includes) a guide to prevent cutting a fingernail or toenail so close to the finger or toe as to cause laceration, infection or other unhealthy outcome. It is also intended to stabilize the nail clipping procedure for users possibly hampered by diminished eyesight, dexterity or equilibrium. More cosmetically, the present invention provides a nail measurement guide to enable the user to maintain his or her nails at a desired length.

Some embodiments of the present invention include equipping a nail clipper with an extendable guide, which may be slidably extended out of or retracted into the lower clipper arm by the user, to preset the desired cut length for clipping fingernails or toenails. (See FIGS. 1-9 and 10-17.) The extendable guide can be set to cut nails at lengths from between about $1/16^{th}$ inch up to about 2 or 2½ inches, allowing the user to preselect the length at which he or she wishes to cut his or her nails. Such adjustable-length guides may be incorporated into the design of the nail clipper, or may be anchored to a standard nail clipper (See FIGS. 18-26). Other embodiments incorporate a fixed-length nail measurement guide into the design of the nail clipper; a separate clipper may be used for each different nail-length desired. (See FIGS. 27-44.)

In one preferred embodiment, depicted in FIGS. 10-17, the guide frame includes preconfigured notches allowing for an incremental movement of the digit stop member and locking into position at the preselected length. The increments of locked positions (grooves seen above) may be approximately ⅛th of an inch apart, allowing for the user to select the length cut of the nail to be adjusted ⅛th of an inch at a time. For example, the user may select a nail cut length of ½ inch, so the digit stop member would be moved from the fully-retracted position to the fourth groove in the lower plate. Each groove on the lower plate may be annotated, and visible by viewing the bottom of the lower plate, displaying the length of the nail cut if that groove is selected. Specifically, the first groove would have the label "⅛th". The second groove would be labeled "⅜th" and so on. The digit stop member should, when fully-extended, offer a nail cut length of no more than about 2 or 2½ inches, and the groove for the notch for that position would be labeled appropriately.

When fully extended, the digit stop member remains securely in the cut length selected, to allow the user to place a fingertip or toe tip against the guide, and place the nail between the cutting blades.

Ideally, when fully retracted, the digit stop member should align with and give the appearance of being an extension of the lower cutting edge.

Figure 20:
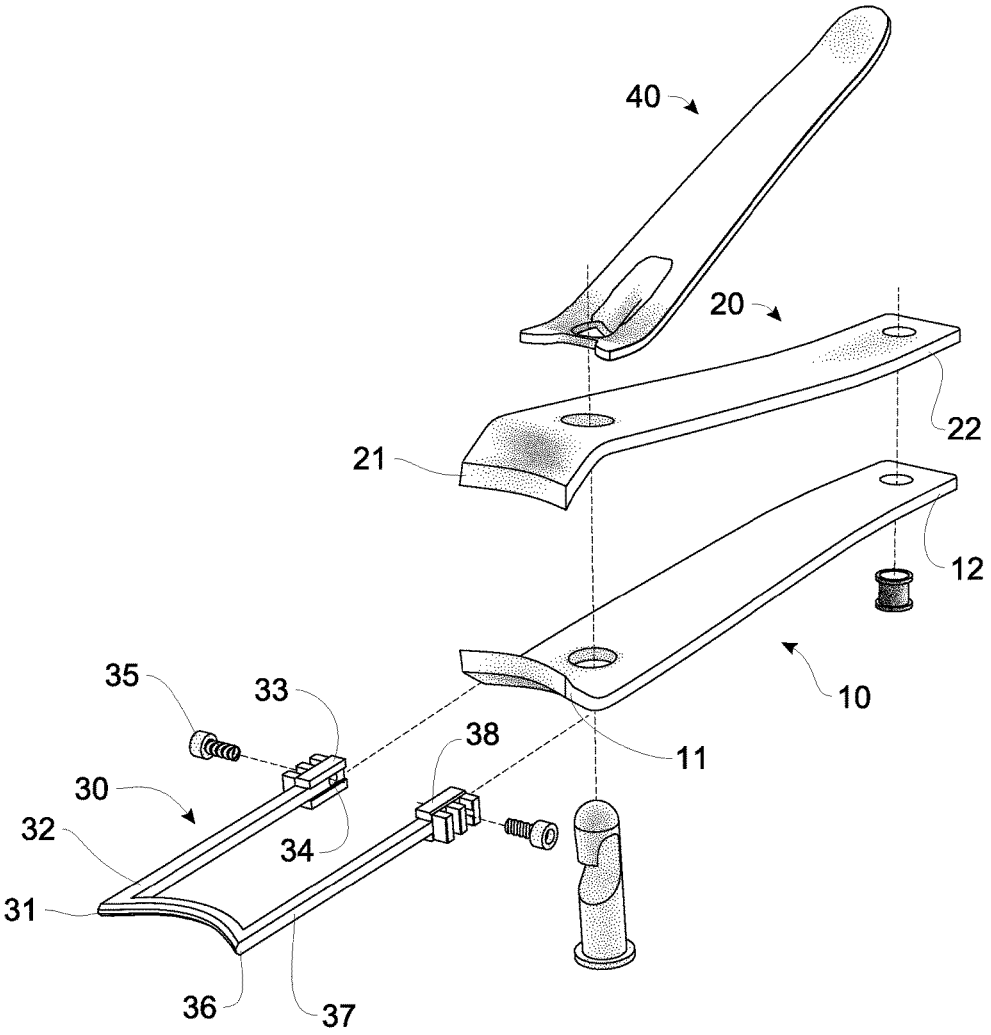
FIG. 20 is an exploded view of thereof, with the prior art clipper comprising all elements other than those labeled with a 30-series reference numeral.
Figure 21:
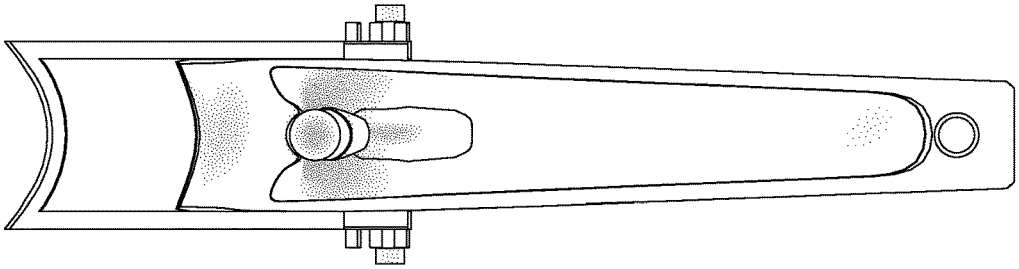
FIG. 21 is a top plan view thereof.
Figure 22:
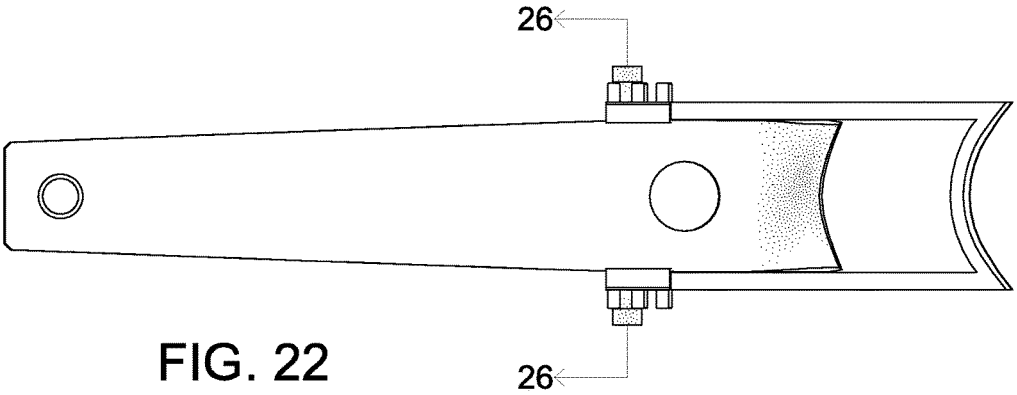
FIG. 22 is a bottom plan view thereof.
Figure 23:
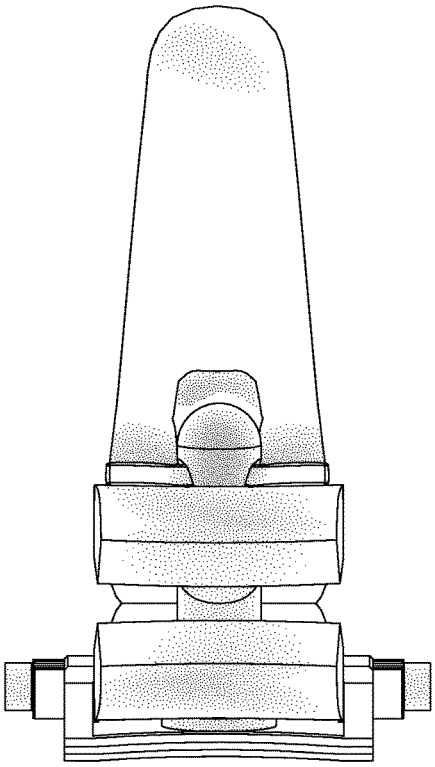
FIG. 23 is a front elevation view thereof.
Figure 24:
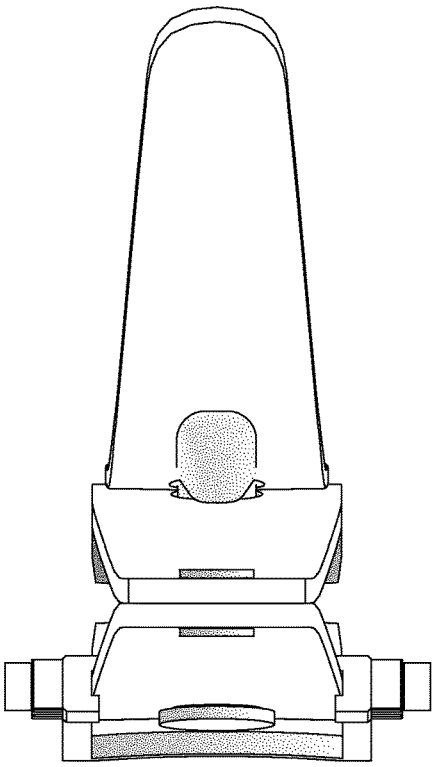
FIG. 24 is a rear elevation view thereof.
Figure 25:
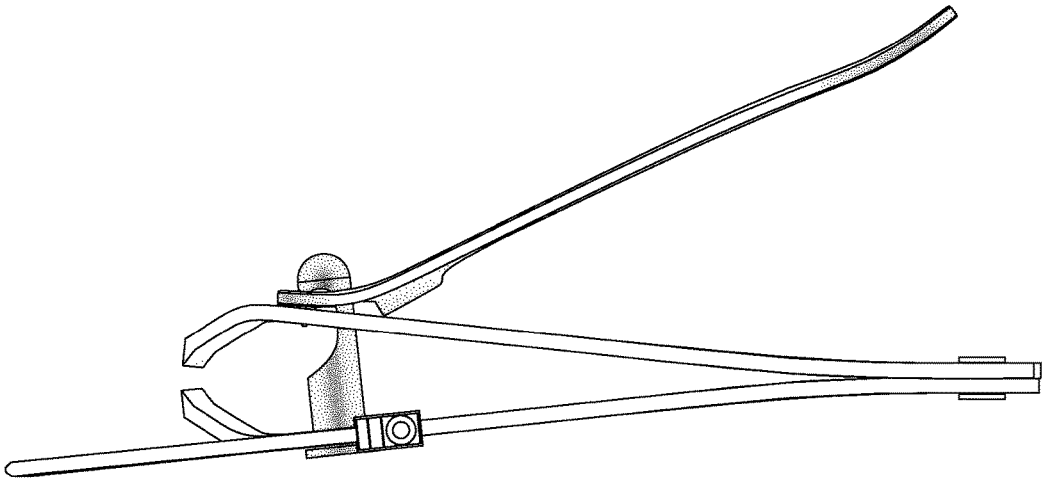
FIG. 25 is a right side elevation view thereof; the left side is a mirror image thereof.
Figure 26:
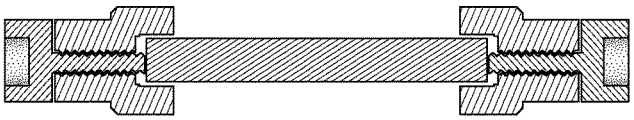
FIG. 26 is a cross-section view thereof, along plane 26-26 of FIG. 22.
Figure 27:
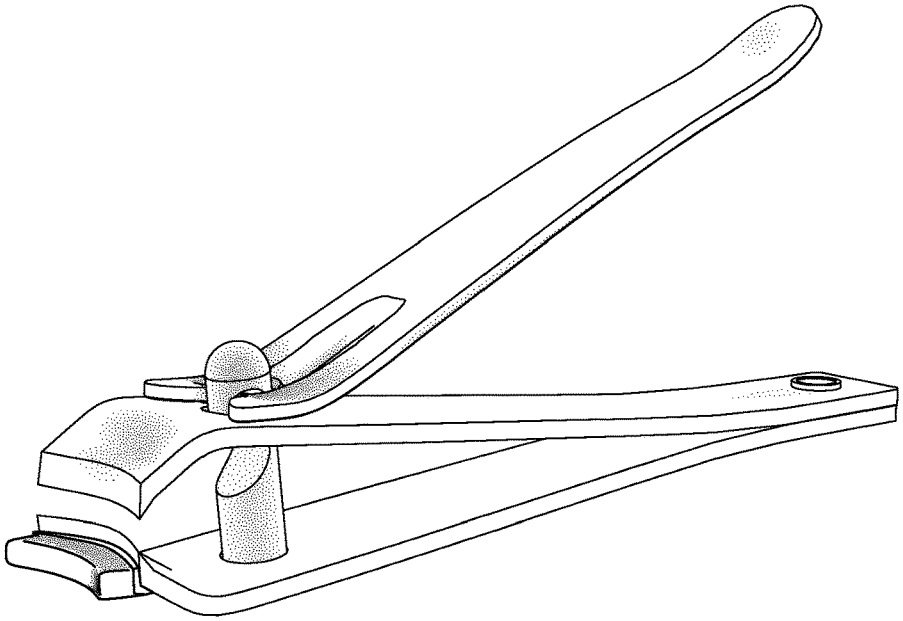
FIG. 27 is a perspective view of another representative sample of a nail clipper, having a fixed-length nail measurement guide.
Figure 28:
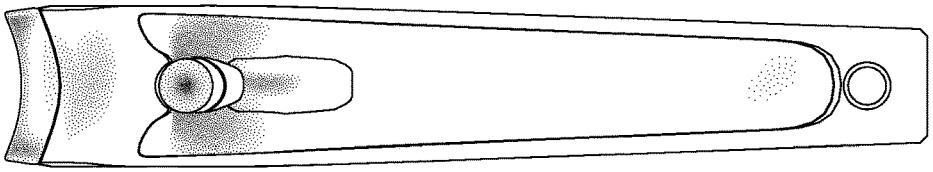
FIG. 28 is a top plan view thereof.
Figure 29:
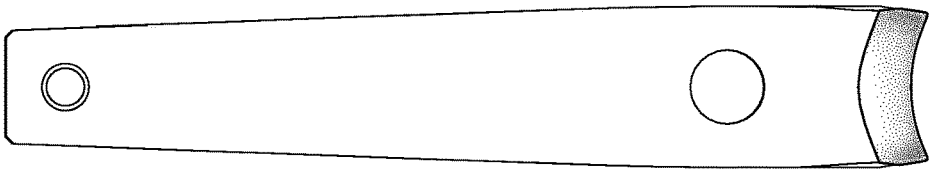
FIG. 29 is a bottom plan view thereof.
Figure 30:
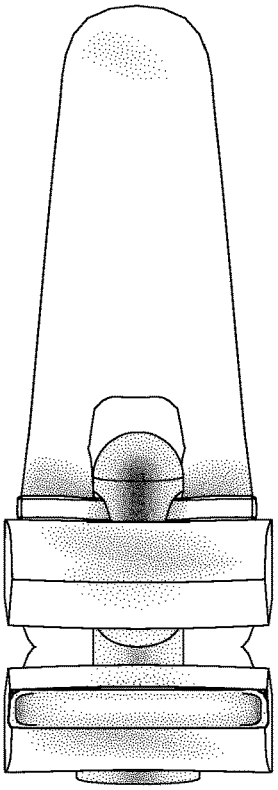
FIG. 30 is a front elevation view thereof.
Figure 31:
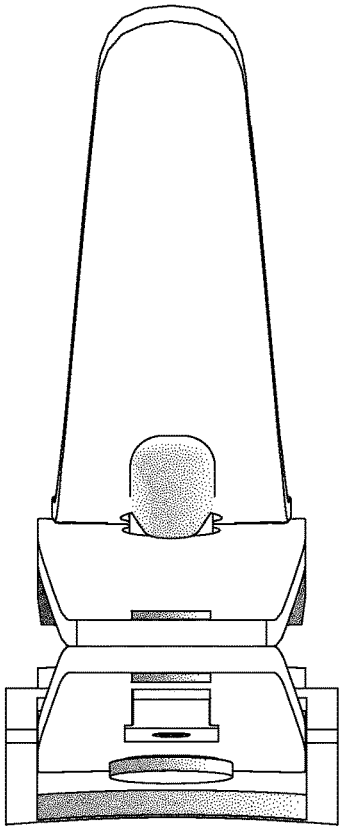
FIG. 31 is a rear elevation view thereof.
Figure 32:
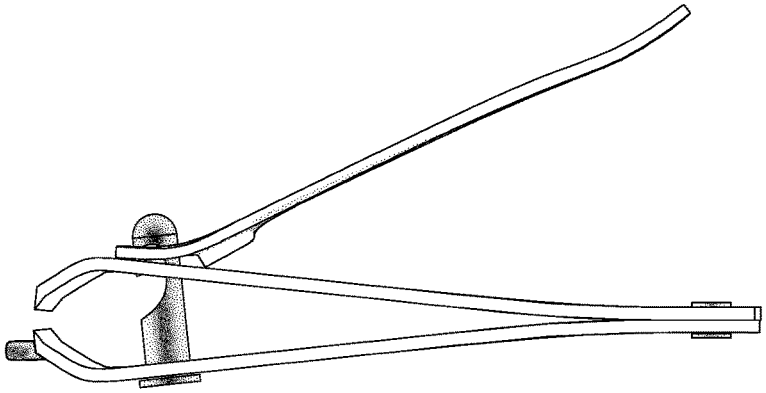
FIG. 32 is a right side elevation view thereof; the left side is a mirror image thereof.
Figure 33:
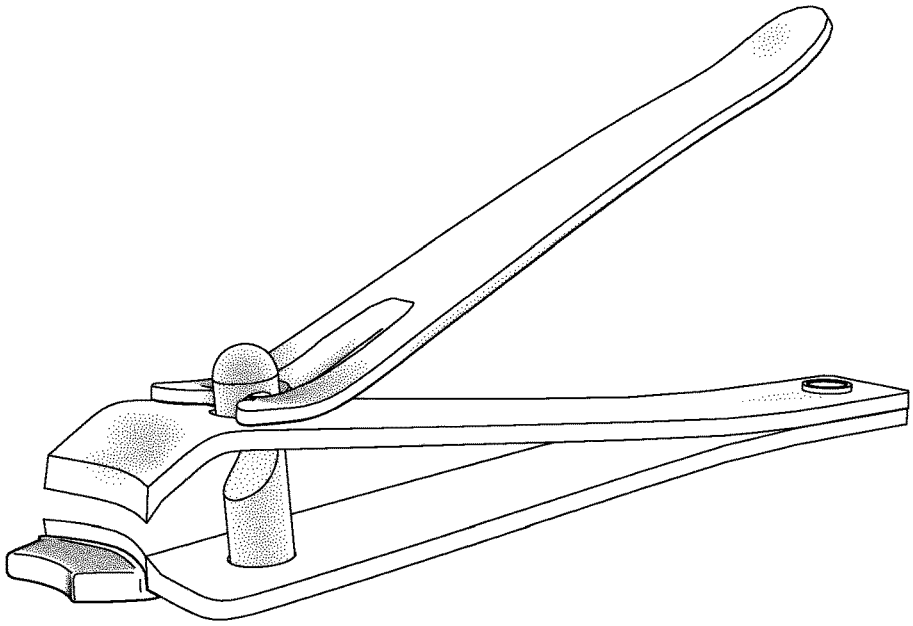
FIG. 33 is a perspective view of another representative sample of a nail clipper, having a fixed-length nail measurement guide having a different length
Figure 34:
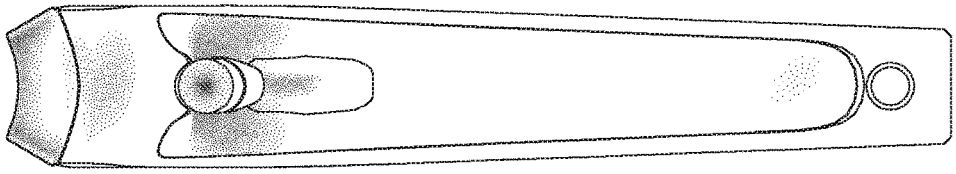
FIG. 34 is a top plan view thereof.
Figure 35:
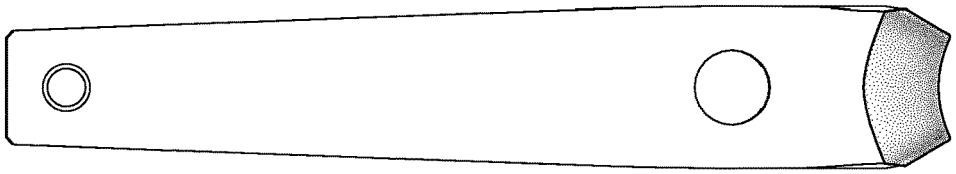
FIG. 35 is a bottom plan view thereof.
Figure 36:
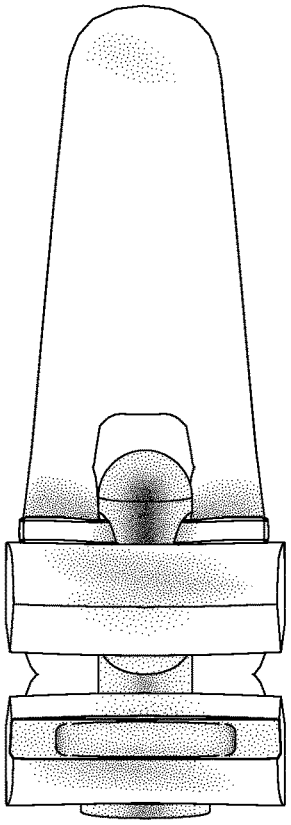
FIG. 36 is a front elevation view thereof.
Figure 37:
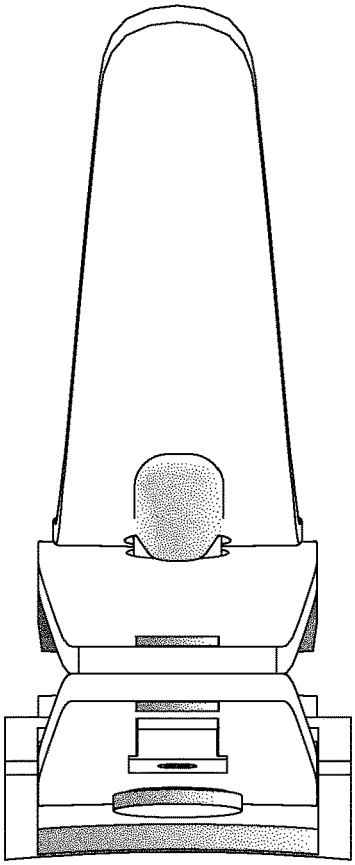
FIG. 37 is a rear elevation view thereof.
Figure 38:
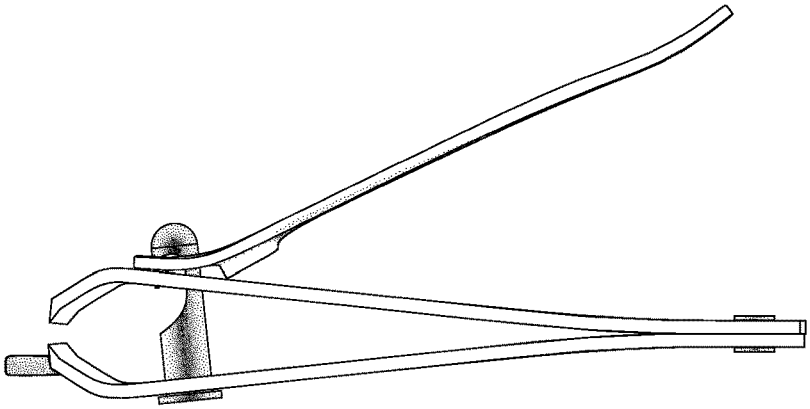
FIG. 38 is a right side elevation view thereof; the left side is a mirror image thereof.
Figure 39:
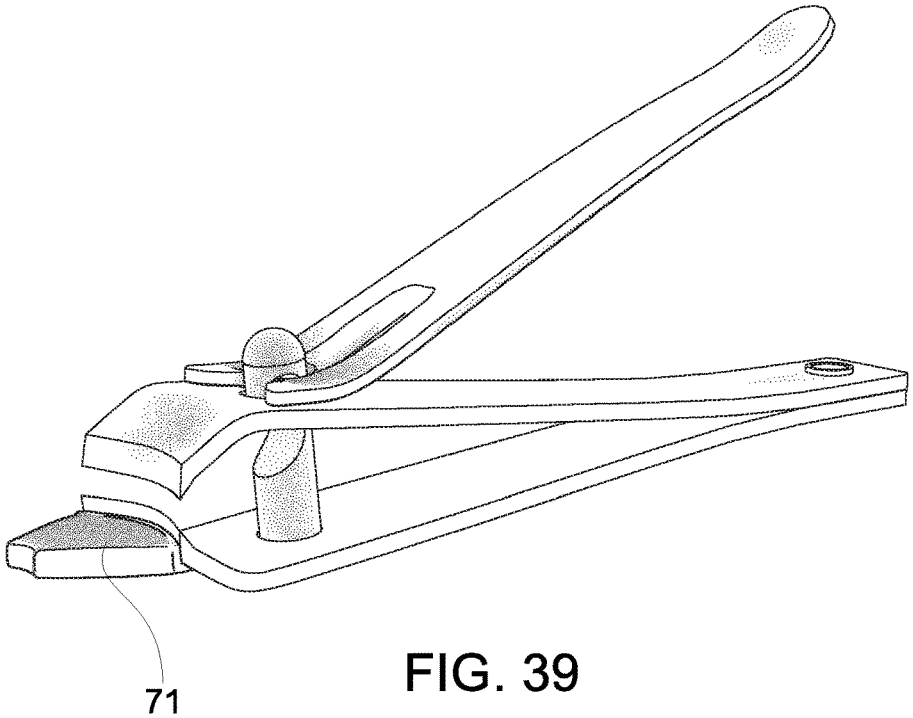
FIG. 39 is a perspective view of another representative sample of a nail clipper, having a fixed-length nail measurement guide having a different length.
Figure 40:
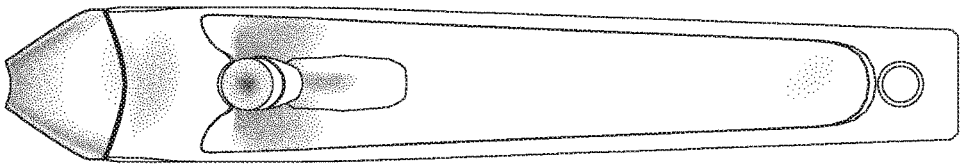
FIG. 40 is a top plan view thereof.
Figure 41:
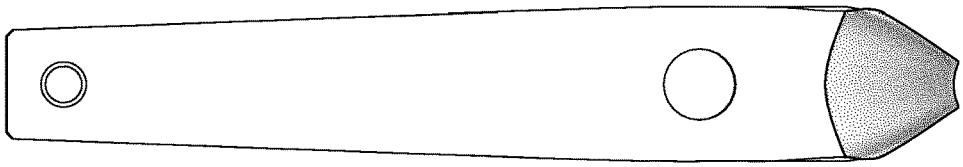
FIG. 41 is a bottom plan view thereof.
Figure 42:
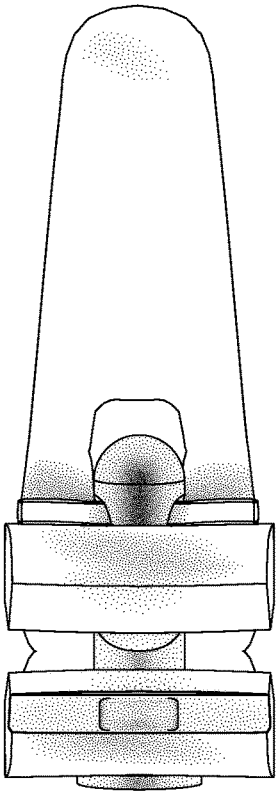
FIG. 42 is a front elevation view thereof.
Figure 43:
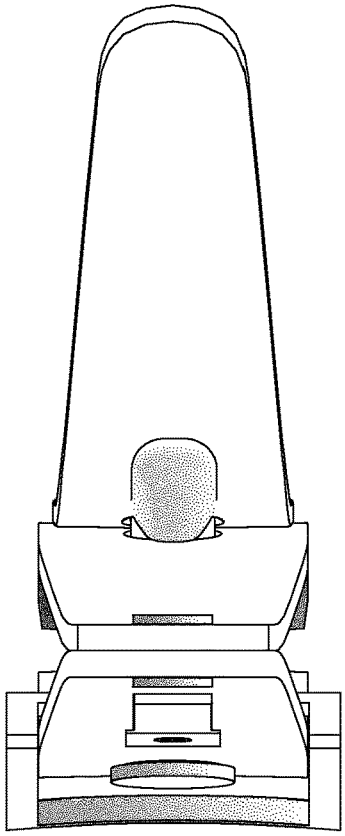
FIG. 43 is a rear elevation view thereof.
Figure 44:
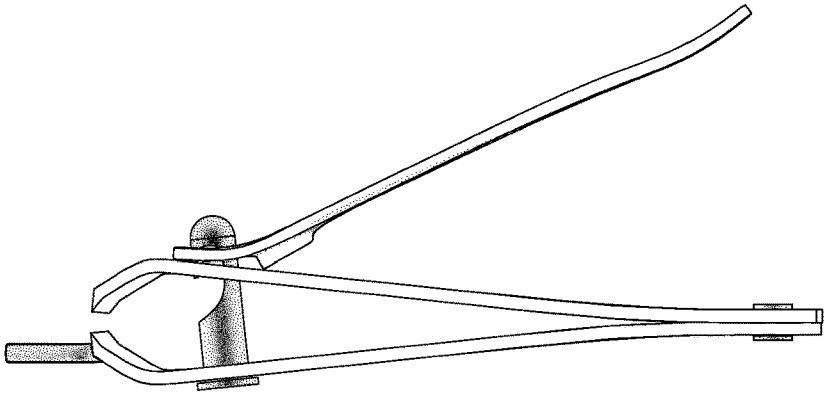
FIG. 44 is a right side elevation view thereof; the left side is a mirror image thereof.

One general embodiment, generally depicted in FIG. 20, comprises (includes) an apparatus attachable to a nail clipper having a lower plate (10) with a lower clipping end (11) and a lower fixed end (12), and having an upper plate (20) with an upper clipping end (21) and an upper fixed end (22); the apparatus may include a means for preventing nail clipping closer than a pre-determined length from the tip of the finger or toe. The means for preventing nail clipping closer than a pre-determined length may include a digit stop member (30) slidably associated with the upper plate or lower plate.

For example, the digit stop member may include a digit stop edge having a first end (31) supported by a first strut (32) terminating in a first terminus (33) adapted to slidably capture a first edge of the upper or lower plate. FIG. 20 depicts a digit stop edge slidably associated with a lower plate. The digit stop edge may preferably have a second end (36) supported by a second strut (37) terminating in a second terminus (38) adapted to slidably capture a second edge of the upper or lower plate. Each respective terminus further may include a fastener fastening the terminus to the respective edge of the plate.

The first terminus may define a first threaded aperture (34), and include an upper extension and a lower extension extending past the first edge of the lower plate captured therebetween. The second terminus may define a second threaded aperture, and include an upper extension and a lower extension extending past the second edge of the lower plate captured therebetween. Each respective terminus further may include a screw (35) screwable into a respective threaded aperture to fasten the terminus to the respective edge of the plate.

The digit stop member may be sized to prevent a digit from being in the range of between about $1/16^{th}$ inch to about 2½ inches from the clipping ends of the clipper when clipping occurs.

Figure 3:
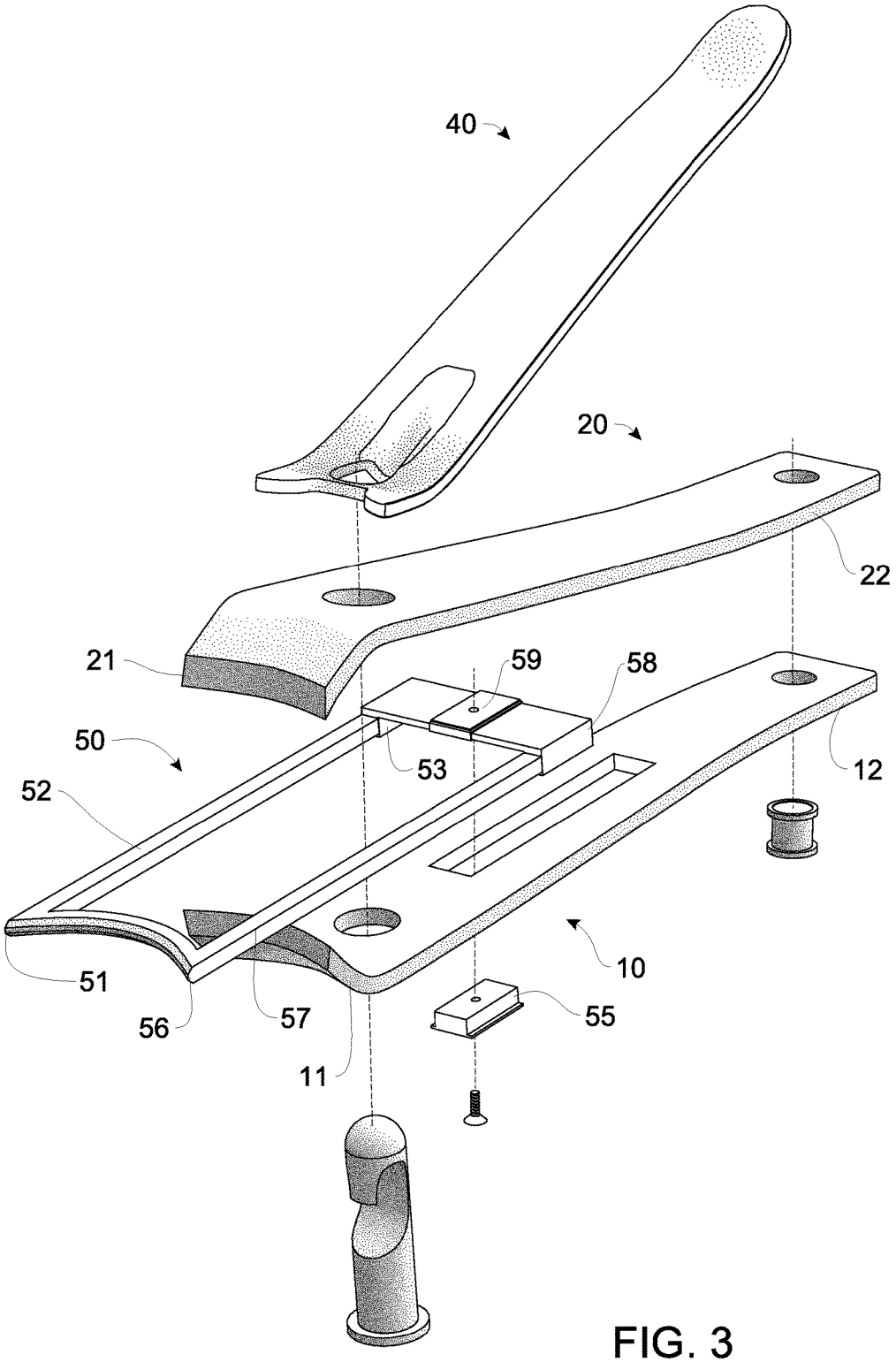
FIG. 3 is an exploded view of thereof.
Figure 4:
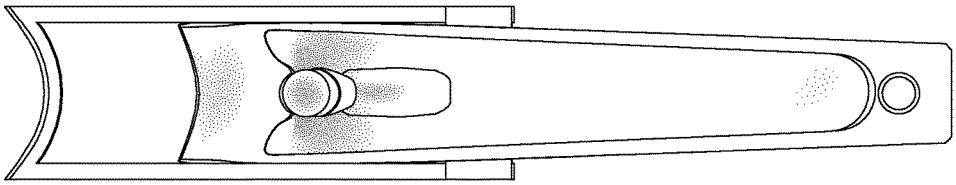
FIG. 4 is a top plan view thereof.
Figure 5:
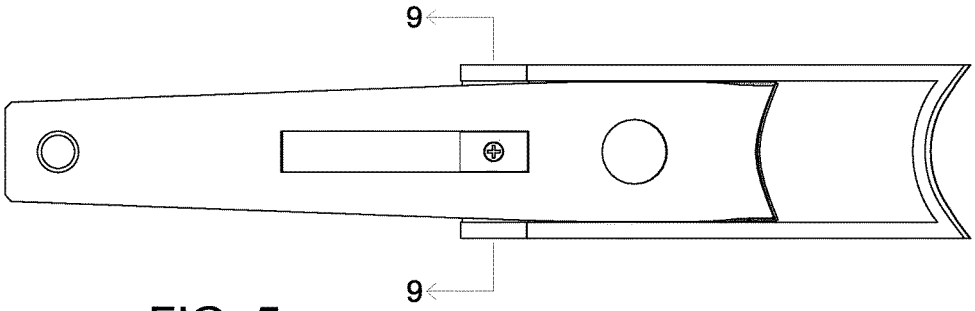
FIG. 5 is a bottom plan view thereof.
Figure 6:
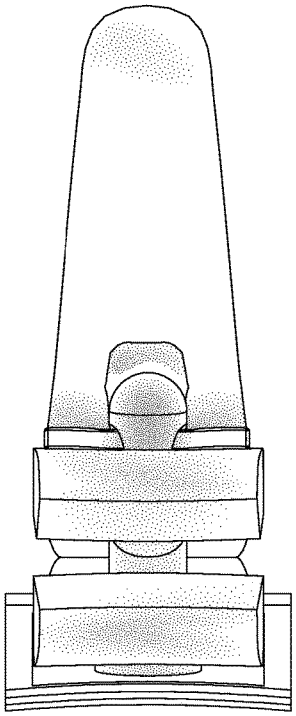
FIG. 6 is a front elevation view thereof.
Figure 7:
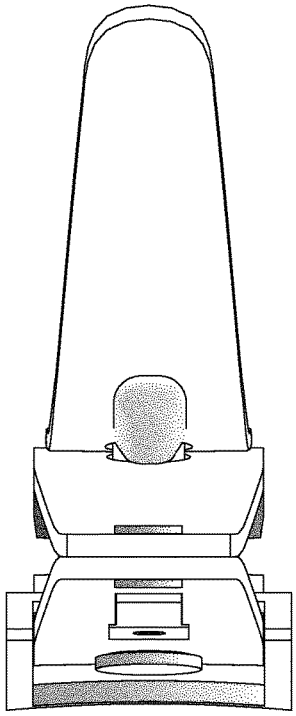
FIG. 7 is a rear elevation view thereof.
Figure 8:
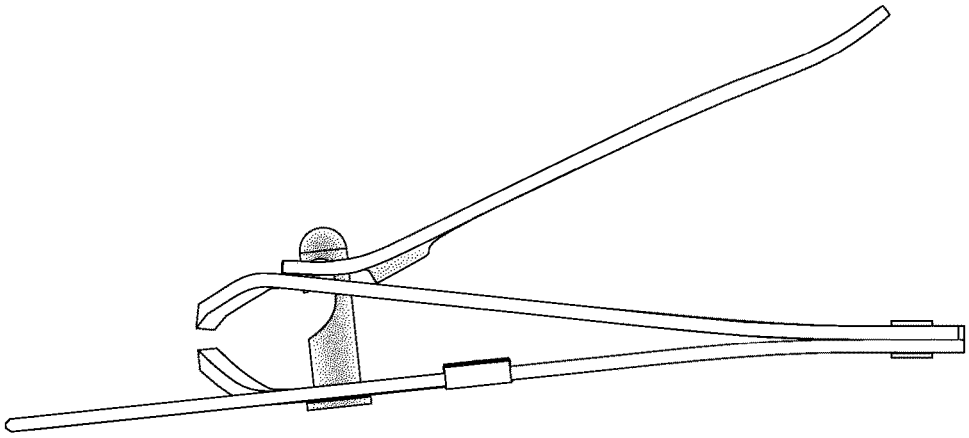
FIG. 8 is a right side elevation view thereof; the left side is a mirror image thereof.
Figure 9:
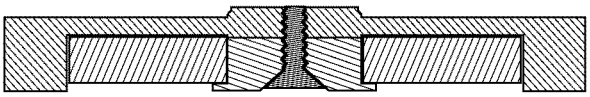
FIG. 9 is a cross-section view thereof, along plane 9-9 of FIG. 5.
Figure 10:
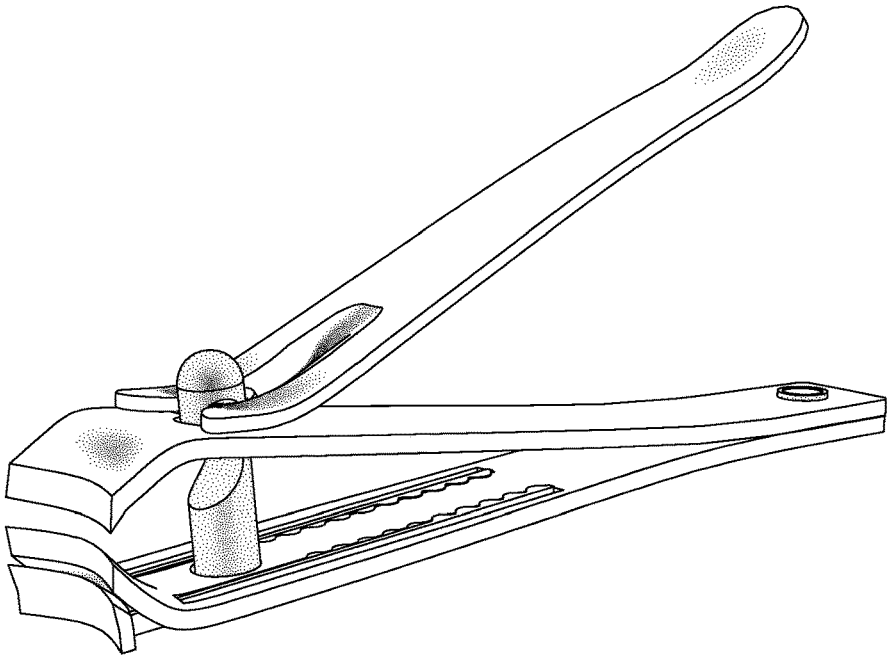
FIG. 10 is a perspective view of another representative sample of a nail clipper in a upright state, having a different mechanism for adjustment of the nail measurement guide.
Figure 11:
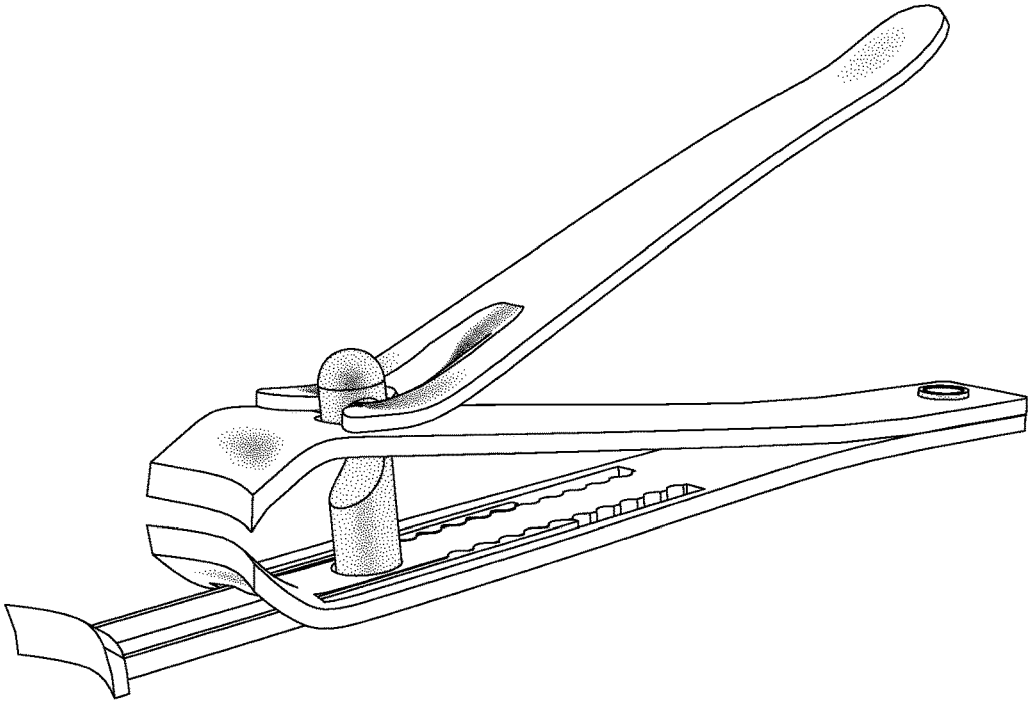
FIG. 11 is a perspective view of the nail clipper of FIG. 10, in a further extended configuration.

In another embodiment of the apparatus, generally depicted in FIG. 3, the lower plate further may include a longitudinal slot. The digit stop member (50) may include a digit stop edge having a first end (51) supported by a first strut (52) terminating in a terminal bridge member (53 to 58). The digit stop edge preferably may have a second end (56) supported by a second strut (57) terminating in the terminal bridge member. The terminal bridge member bridges between the two ends of the struts, and includes a threaded aperture (59) aligned with the slot.

The means for preventing nail clipping closer than a pre-determined length further may include a fastening member (55) defining an aperture (59) aligned with the threaded aperture of the terminal bridge member. That fastening member may be adapted to occupy a portion of the slot, and slide longitudinally therein until fastened by a fastener extending through the apertures. The fastening member may include a first longitudinal extension and an opposite second longitudinal extension extending past the longitudinal slot and further facilitating the capture of the lower plate.

Figure 12:
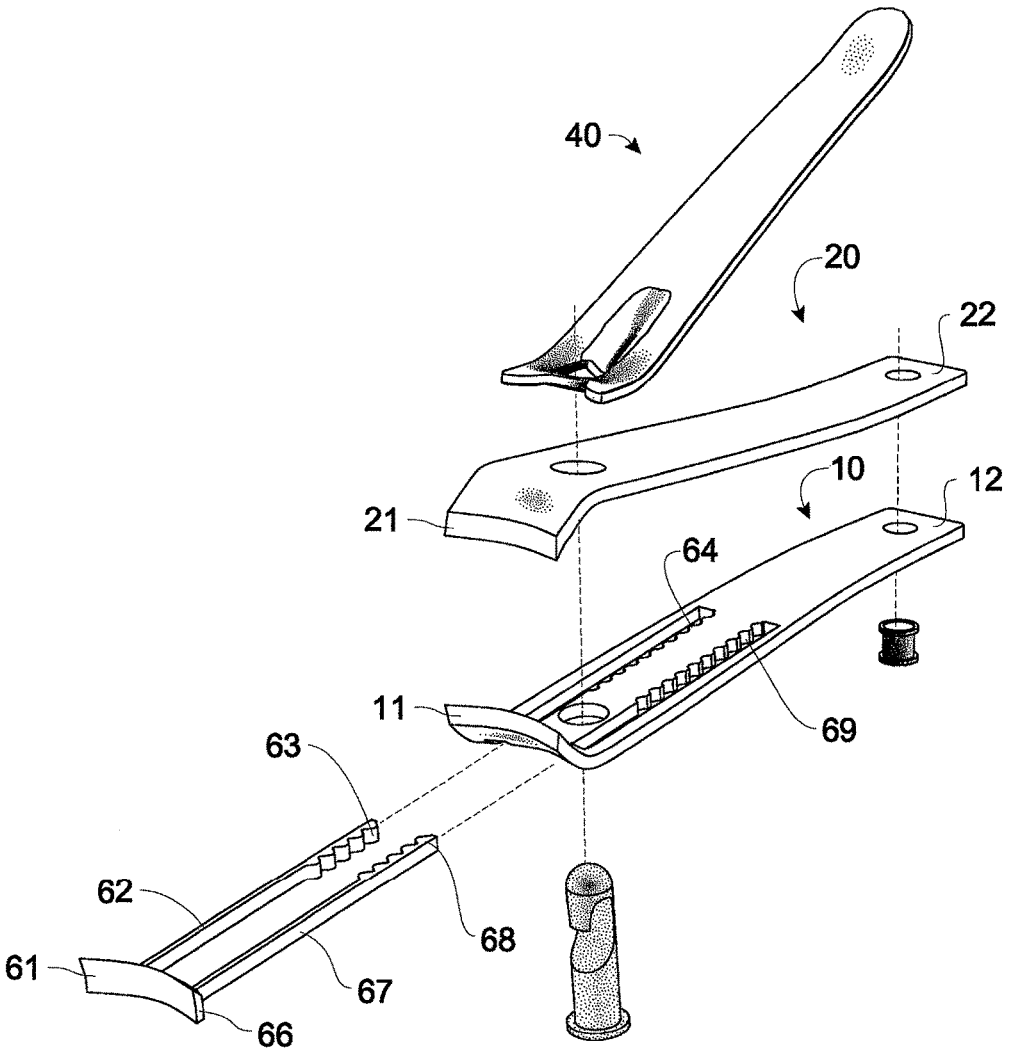
FIG. 12 is an exploded view of thereof.
Figure 13:
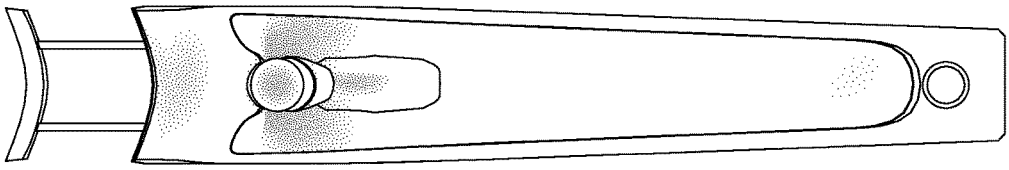
FIG. 13 is a top plan view thereof.
Figure 14:
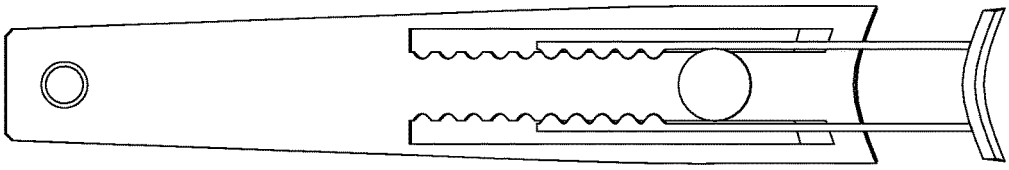
FIG. 14 is a bottom plan view thereof.
Figure 15:
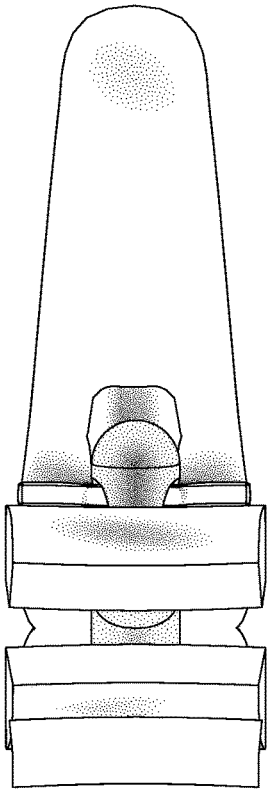
FIG. 15 is a front elevation view thereof.
Figure 16:
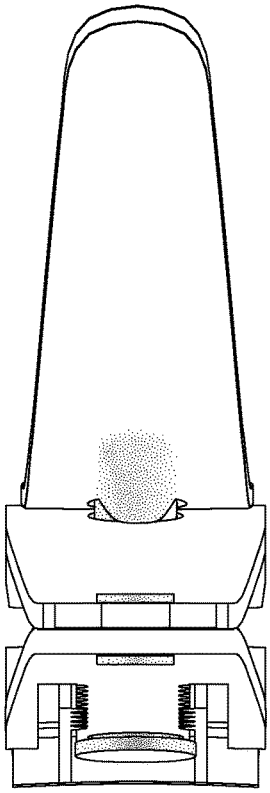
FIG. 16 is a rear elevation view thereof.
Figure 17:
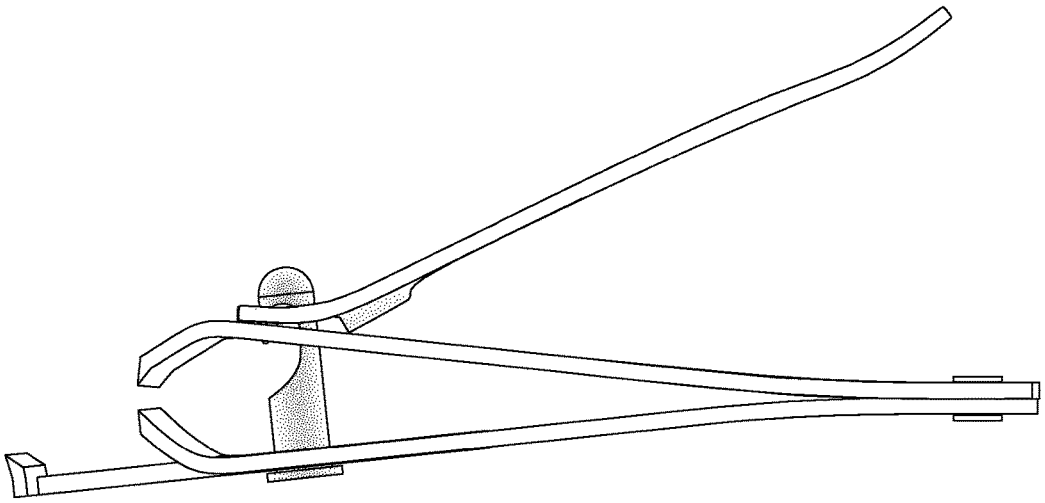
FIG. 17 is a right side elevation view thereof; the left side is a mirror image thereof.
Figure 18:
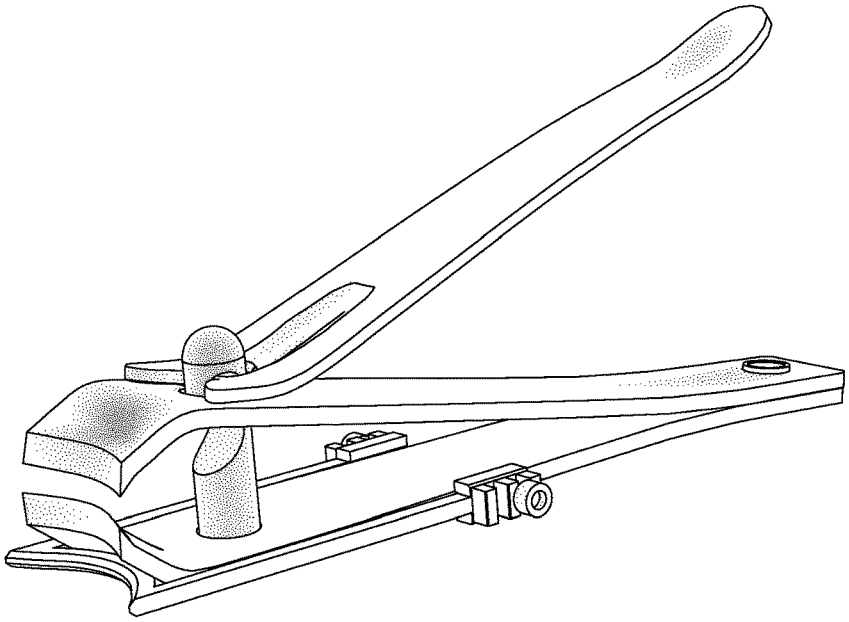
FIG. 18 is a perspective view of a prior art nail clipper retrofitted with a representative sample of the current invention.
Figure 19:
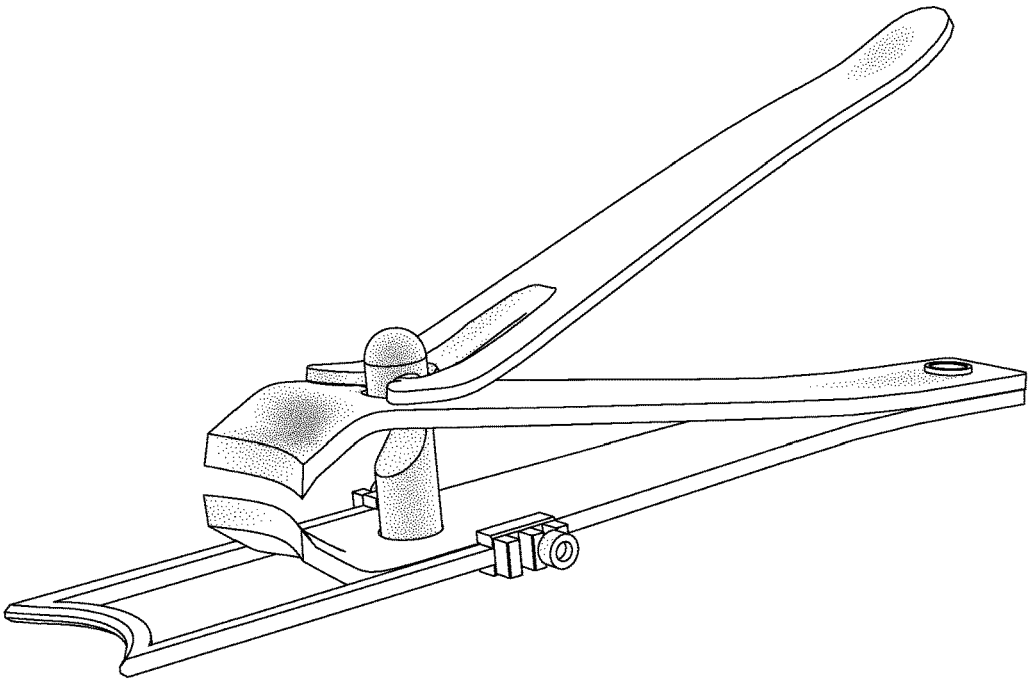
FIG. 19 is a perspective view of the nail clipper of FIG. 18, in a further extended configuration.

In another embodiment, generally depicted in FIG. 12, the lower plate (10) further may include a first longitudinal slot having periodic notches (64) along at least one longitudinal side thereof, and a second longitudinal slot having periodic notches (69) along at least one longitudinal side thereof. The digit stop member may include a digit stop edge having a first end (61) supported by a first strut (62) slidable within the first longitudinal slot and having notch-teeth (63) along at least one longitudinal edge corresponding to the notches (64) of the first longitudinal slot. The digit stop edge may preferably include a second end (66) supported by a second strut (67) slidable within the second longitudinal slot and having notch-teeth (68) along at least one longitudinal edge corresponding to the notches (69) of the second longitudinal slot. The interface of the notches and notch-teeth should determine the length between the clipping ends and the finger or toe having a nail to be clipped.

Ideally the notch-teeth (63) in the longitudinal edge of the first strut (62) will point towards the notch-teeth 68) in the longitudinal edge of the second strut (69), and the struts will be resiliently biased inwardly towards the other. However, any arrangement of notches and notch-teeth are acceptable if the structural and functional requirements of setting and maintaining the length of the struts are satisfied.

The disclosed invention also includes a nail clipper having an integral digit stop member extending from the lower or upper clip end, preventing nail clipping closer than a single pre-determined length from the tip of the finger or toe. The clipper may include a lower plate with a lower clipping end and a lower fixed end, an upper plate with an upper clipping end and an upper fixed end, and a digit stop member (71) anchored to the lower clipping end or the upper clipping end. Preferably, the digit stop member may be anchored to the lower clipping end.

A separate clipper may be needed for each fixed length desired. For example, one clipper may have the length fixed at ½ inch between the lower clipping end and the tip of the digit having a nail to be clipped. A different clipper may be utilized for a fixed length of ½ inch, while yet another clipper may be utilized for a fixed length of ¾ inch.

In the operation of a clipper embodiment with an adjustable guide, the user sets the guide (digit stop edge) to the particular nail cut length, then positions the clipping end of the clipper with the guide touching the tip of the finger or toe, and positioning the fingernail or toenail between the clipping jaws of the clipper, then depressing the actuation arm (40) until the nail is clipped.

I claim:

1. A nail clipper comprising, when in an upright state, a lower plate with a lower clip end, a lower fixed end, and a plurality of slots, said plurality of slots comprising a first longitudinal slot having periodic notches along at least one longitudinal side thereof and a second longitudinal slot having periodic notches along at least one longitudinal side thereof; an upper plate with an upper clip end and an upper fixed end fixed to the lower fixed end; and a digit stop member comprising a digit stop edge for engagement with a finger or toe having a nail to be cut, said digit stop edge supported by a first strut slidably received in said first longitudinal slot and having notch-teeth along at least one longitudinal edge of said first strut corresponding to said notches of said first longitudinal slot and by a second strut slidably received in said second longitudinal slot and having notch-teeth along at least one longitudinal edge of said second strut corresponding to said notches of said second longitudinal slot, respective interfaces between said notches and said notch-teeth together define an extension length between said clip ends and said digit stop edge.

2. A nail clipper described in claim 1, said extension length is between about $1/16^{th}$ inch to about 2.5 inches.

3. A nail clipper described in claim 1, said notch-teeth in the longitudinal edge of said first strut pointing towards said notch-teeth in the longitudinal edge of said second strut, and said struts resiliently biased inwardly towards the other.

4. A nail clipper comprising, when in an upright state, a lower plate having a first fixed end, an opposite first clip end including a first clip edge, and a plurality of slots, said plurality of slots comprising a first longitudinal slot having periodic notches along at least one longitudinal side thereof and a second longitudinal slot having periodic notches along at least one longitudinal side thereof; an upper plate having a second fixed end fixed to the first fixed end and an opposite second clip end including a second clip edge; and a digit stop member comprising a digit stop edge for engagement with a finger or toe having a nail to be cut, said digit stop edge supported by a first strut slidably received in said first longitudinal slot and having notch-teeth along at least one longitudinal edge of said first strut corresponding to said notches of said first longitudinal slot, said digit stop edge supported by a second strut slidably received in said second longitudinal slot and having notch-teeth along at least one longitudinal edge of said second strut corresponding to said notches of said second longitudinal slot, said digit stop edge extending in a range between about 1/8th inch to about 2.5 inches from the clip edges.

* * * * *